US005448344A

United States Patent [19]

Itakura et al.

[11] Patent Number: 5,448,344

[45] Date of Patent: Sep. 5, 1995

[54] FLASH LAMP FIXING DEVICE

[75] Inventors: Tatsuya Itakura; Rika Nishiwaki; Tadayoshi Nakata, all of Kawasaki; Shigehiro Fujii, Hyogo; Tomoaki Fukuda, Hyogo; Naoyuki Fujimoto, Hyogo; Mitsuhiro Hirohata, Hyogo; Yoshizi Atsumi, Kawasaki, all of Japan

[73] Assignee: Fujitsu Limited, Kawasaki, Japan

[21] Appl. No.: 141,106

[22] Filed: Oct. 26, 1993

[30] Foreign Application Priority Data

Feb. 24, 1993 [JP] Japan ..... 5-035641
Jul. 23, 1993 [JP] Japan ..... 5-182827

[51] Int. Cl.[6] ..... G03G 15/00; G03G 15/20
[52] U.S. Cl. ..... 355/288; 219/216
[58] Field of Search ..... 355/288, 309, 311; 219/216; 432/59

[56] References Cited

U.S. PATENT DOCUMENTS 5,296,906 3/1994 Hano et al. ..... 355/311

FOREIGN PATENT DOCUMENTS 55-12942 1/1980 Japan .
60-252383 12/1985 Japan ..... 355/288
62-20969 1/1986 Japan .
62-40714 8/1987 Japan .
2-296272 12/1990 Japan ..... 355/288

*Primary Examiner*—Joan H. Pendegrass
*Attorney, Agent, or Firm*—Armstrong, Westerman, Hattori, McLeland and Naughton

[57] ABSTRACT

A flash lamp fixing with a simple structure, capable of obtaining an even distribution of high-level luminous energy over a large area on the surface of a paper sheet illuminated by a flash lamp. In the flash lamp fixing device, the half breadth $L_1$ of the aperture of the reflector is set so as to satisfy the equation $V/T \geqq L_1 \geqq V/T - L_2/2$, where V is the conveying speed of a paper sheet; T is the flash cycle of the flash lamp; $L_1$ is the half breadth of the aperture of the reflector; and $L_2$ is the length of an area in which fixing can be done by one flash of the flash lamp. Where $\theta_1$ represents the included angle between a tangent which passes through one of aperture edges, being tangent to the flash lamp on the side of the aperture and the plane of the aperture; and $\theta_2$ represents the included angle between a tangent which passes through the aperture edge, being tangent to a safety distance critical circle centered on the center of the flash lamp and a plane normal to the aperture plane, the tilt angles of the respective inclined face parts in relation to the plane normal to the aperture plane are set to be not less than $\theta_1$ and not more than $\theta_2$.

20 Claims, 16 Drawing Sheets

* AREA JUST UNDER THE LAMP

* AREA JUST UNDER THE LAMP

* AREA JUST UNDER THE LAMP

* AREA JUST UNDER THE LAMP

FLASH LAMP FIXING DEVICE

TECHNICAL FIELD

The present invention relates to a flash lamp fixing device for use with an image forming apparatus such as a copying machine, printer and facsimile, for fixing a toner image formed on a paper sheet.

BACKGROUND ART

In a widely known image forming apparatus such as a copying machine, printer and facsimile, image forming is generally performed with the following procedure: The surface of a photosensitive member is exposed to a light image of an original in an optical system to form an electrostatic latent image on the photosensitive member. Then, electrically charged toner is adhered to tile electrostatic latent image in a developing unit to form a toner image and this toner image is transferred onto a paper sheet in a transferring unit. The toner image thus transferred is fixed on the paper sheet in a fixing unit. A conventional fixing device employed in such a fixing unit generally employs a heating means such as a heat roller or infrared lamp in order to heat toner thereby fusing tile toner on tile paper sheet.

In a fixing device using a heating means such as a heat roller, toner and a paper sheet are heated in the substantially same temperature environment and, therefore, there often arises the problem that the paper sheet is scorched or burnt. In order to avoid such a problem, a so-called flash lamp fixing device is recently often used, in which the luminous energy of a flash lamp is utilized. In a flash lamp fixing device, a flash lamp such as, for example, a xenon lamp flashes intermittently, causing toner on a paper sheet to instantaneously absorb its luminous energy so that the toner permeates the paper sheet with the resinous components being melted, and in this way, the toner can be fixed on the paper sheet.

The problem with the above flash lamp fixing device is that when fixing is carried out only by intermittent flashing of a flash lamp, luminous energy ($PD_p$ (V)) generated by one flash of the flash lamp is extremely small as shown in FIG. 23 and therefore toner cannot be fixed over a large area on the paper sheet.

For the purpose of effectively fixing toner in a specified area of a paper sheet, one proposal is disclosed in Japanese Patent Publication No. 62-40714 (1987). According to the flash lamp fixing device taught by the above publication, there are provided a reflector 53 enclosing a flash lamp 51 and a glass plate 54 disposed between the flash lamp 51 and a paper sheet 52, as shown in FIG. 24. The reflector 53 is made up of inclined face parts 53a which are inclined like an unfolded fan widened towards the paper sheet 52 and a back face part **53*b* disposed between the inclined face parts 53*a* and behind the flash lamp 51. The provision of the reflector 53 for reflecting part of light emitted from the flash lamp 51 towards the paper sheet 52 enables it to entirely increase luminous energy which reaches the paper sheet 52 by one flash, so that fixing can be performed on a larger area, as shown in FIG. 25**.

DISCLOSURE OF THE INVENTION

The above flash lamp fixing device, however, presents the problem that in spite of the provision of the reflector 53, variations have been found in the rate of fixing toner on the paper sheet 52, which could be the cause of fixing blurs. The variations are attributable to the characteristic of the distribution of luminous energy which reaches the paper sheet 52 (see FIG. 25), in which the luminous energy peaks at a position just under the flash lamp 51, decreasing sharply as the measuring point is remote from the position just under the flash lamp 51 in lateral directions. Another problem is that when luminous energy generated at a position just under the Flash lamp 51 is excessively strong, the void (rupture) phenomenon of toner occurs, degrading the fixing rate at the position just under the flash lamp 51 and causing toner to be scattered, by which the surface of the glass plate 54 gets dirty.

The invention has been made taking these drawbacks into consideration and the prime object of the invention is therefore to provide a flash lamp fixing device having a simple structure and capable of obtaining an even distribution of high-level luminous energy over a large area on the surface of a paper sheet illuminated by a flash lamp.

According to one aspect of the invention, there is provided a flash lamp fixing device comprising a flash lamp and a reflector which is so formed as to enclose the flash lamp except for an aperture formed at a side of the flash lamp, for reflecting part of light emitted from the flash lamp towards the aperture, wherein the following equation holds:

$$V/T > L_1 V/T - L_2/2$$

where V is the conveying speed of a paper sheet; T is the flash cycle of the flash lamp; $L_1$ is the half breadth of the aperture of the reflector; and $L_2$ is the length of an area in which fixing can be done by one flash of tile flash lamp.

In the above-described flash lamp fixing device, since the half breadth $L_1$ of the aperture of the reflector is set in the range defined by $V/T \geqq L_1 \geqq V/T - L_2/2$, when the half breadth $L_1$ is equal to the maximum value V/T ($L_1 = V/T$), flash fixing is performed two times without intermission on the surface of the paper sheet during the passage of the paper sheet through the fixing device, except for the leading end of the paper sheet which passes through the fixing device at the start of fixing. On the other hand, when the half breadth $L_1$ is equal to the minimum value $V/T - L_2/2$ ($L_1 = V/T - L_2/2$), flash fixing is performed once on the leading end of the paper sheet which passes through the fixing device at the start of fixing as well as on areas of the paper sheet that come to a position just under the flash lamp, whilst flash fixing is performed twice on other areas than the leading end and the areas that come to a position Just under the flash lamp. Apart from the leading end of the paper sheet which passes through the fixing device at the start of fixing, flash fixing is always performed two times on other areas than the areas that come to a position just under the flash lamp where satisfactory fixing effects can be achieved by one time of flash fixing. With this arrangement, the luminous energy distribution on the paper sheet can be averaged and therefore the fixing rate is improved.

According to another aspect of the invention, there is provided a flash lamp fixing device comprising a flash lamp and a reflector which is so formed as to enclose the flash lamp except for an aperture formed at a side of the flash lamp, for reflecting part of light emitted from the flash lamp towards the aperture, wherein the reflector is formed with a pair of inclined face parts which are disposed on both lateral sides of the flash lamp, inclining like an unfolded fan widened towards a paper sheet and a back face part disposed intermediate the inclined face parts and behind the flash lamp, and wherein where $\theta_1$ represents the included angle between a tangent which passes through one of aperture edges of the reflector, being tangent to the flash lamp on the side of the aperture and the plane of tile aperture; and $\theta_2$ represents the included angle between a tangent which passes through the aperture edge, being tangent to a safety distance critical circle centered on the centre of the flash lamp and a plane normal to the aperture plane, the tilt angles of the respective inclined face parts in relation to the plane normal to the aperture plane are set to be not less than $\theta_1$ and not more than $\theta_2$.

If the tilt angles of the inclined face parts are set to $\theta_1$, emitted light from the flash lamp will be reflected at each of the aperture edges of the reflector in a direction normal to the aperture plane so that the light can be directed from the aperture plane onto the paper sheet at right angles thereto.

On the other hand, if the tilt angles of the inclined face parts are set to be less than $\theta_1$, light will be reflected off the inclined face parts in a direction deviated towards the centre of the reflector so that light reflected from an posterior end of one inclined face part will be directed to the other inclined face part at the opposite side and subjected to secondary reflection thereat. This makes the optical path to be prolonged, resulting undesirably in the damping of luminous energy of light illuminated to the paper sheet.

The tilt angles of the inclined face parts are preferably $\theta_1$ or more and as large as possible. However, if the tilt angles exceed $\theta_2$, it leads to such a undesirable situation that the inclined face parts intersect the safety distance critical circle and the leakage of electric charge is likely to occur from the flash lamp to the inclined face parts. If the tilt angles of the inclined face parts are set to $\theta_2$, the distances between the flash lamp and the respective inclined face parts can be minimized within the range in which the leakage of electric charge does not occur and the damping amount of luminous energy of light reflected at the inclined face parts can be restrained.

Preferably, the posterior end of each of the inclined face parts is located closer to one of the aperture edges than an intersection of the oblique line of the inclined face part and a circle which encloses the flash lamp, being tangent thereto and is centered on a middle point between the centre of the flash lamp and the aperture edge.

By setting the posterior end of each of the inclined face parts so as to be located closer to one of the aperture edges than an intersection of the oblique line of the inclined face part and a circle which encloses the flash lamp being tangent thereto and is centered on a middle point between the centre of the flash lamp and the aperture edge, incident light from the flash lamp inclines towards the aperture edge rather than makes right angles with the posterior end of the inclined face part so that the light can be reflected towards the aperture plane. This prevents the secondary reflection in which light reflected off the posterior end of one inclined face part is directed to and reflected at the other inclined face part at the opposite side so that the damping of luminous energy caused by a prolonged optical path can be reduced.

The back face part of the reflector may be made into any one of the following shapes:

(1) a flat face which is parallel with the aperture plane, being tangent to the safety distance critical circle or passing outside the safety distance critical circle;

(2) a curved face which is tangent to the safety distance critical circle or passes outside the safety distance critical circle; or (3) a bent face which is tangent to the safety distance critical circle or passes outside the safety distance critical circle.

The aforesaid bent face is embodied in such variations: (1) a bent face comprising an angled face projecting in a direction opposite to the aperture plane; (2) a bent face comprising an angled face projecting in a direction opposite to the aperture plane and flat faces which continue from both sides of the angled face, being parallel with the aperture plane; (3) a bent face comprising a flat face parallel with the aperture plane and slant faces which continue from both sides of the flat face; and (4) a bent face comprising a curved face along (coincident with) an are of the safety distance critical circle and flat faces which continue from both sides of the curved face, being parallel with the aperture plane.

It is also possible that the tilt angles of the inclined face parts are set to $\theta_2$, the posterior end of each of the inclined face parts is set at the point of contact of a tangent to the safety distance critical circle and the back face part is a curved face running along (or coincident with) an are of the safety distance critical circle.

Further, the flash lamp fixing device may be designed such that a plurality of flash lamps are disposed in parallel with each other, being a specified distance separated from the aperture plane and the inclined face parts are disposed outside the outermost flash lamps.

According to another aspect of the invention, there is provided a flash lamp fixing device comprising a flash lamp and a reflector which is so formed as to enclose the flash lamp except for an aperture formed at a side of the flash lamp, for reflecting part of light emitted from the flash lamp towards the aperture, wherein the reflector is formed with a pair of inclined face parts which are disposed on both lateral sides of the flash lamp, inclining like an unfolded fan widened towards a paper sheet and a back face part disposed intermediate the inclined face parts and behind the flash lamp, and wherein the back face part is composed of two angled faces which are symmetrically placed and caved in a direction toward the aperture plane.

In this case, at least the back face part of the reflector may assume the form of a bellows in which angled face(s) projecting in a direction opposite to the aperture plane and angled face(s) caved in a direction towards the aperture plane are successively aligned, or may be configured to have a plurality of projections or concaves which are disposed in a regular manner, each taking the form of a polygonal pyramid or truncated polygonal pyramid. The arrangement, in which the back face part of the reflector is composed of two angled faces symmetrically placed and caved in a direction towards the aperture plane, or in which at least the back face part of the reflector is made into a bellows-like form comprising angled face(s) projecting in a direction opposite to the aperture plane and angled face(s)

caved in a direction towards the aperture plane, these angled faces being aligned in a continuous fashion, or in which at least the back face part includes a plurality of projections or concaves disposed regularly, each taking the form of a polygonal pyramid or truncated polygonal pyramid, makes it possible to irregularly reflect and disperse luminous energy from the flash lamp not only in a direction towards the area just under the flash lamp but also in various directions. This enables an averaged luminous energy distribution which improves the fixing rate.

According to still another aspect of the invention, there is provided a flash lamp fixing device comprising a flash lamp and a reflector which is so formed as to enclose the flash lamp except for an aperture formed at a side of the flash lamp, for reflecting part of light emitted from the flash lamp towards the aperture, wherein the flash lamp is disposed at a position deviated from the centre of the aperture width of the reflector towards the downstream of a paper conveying direction, and wherein the following equation holds: $L_3 \geqq 2V/T$, where V is the conveying speed of a paper sheet; T is the flash cycle of the flash lamp; and $L_3$ is the aperture width of the reflector.

With the above arrangements in which the flash lamp is disposed at a position deviated from the centre of the aperture width of the reflector towards the downstream of the paper conveying direction and in which the aperture width $L_3$ of the reflector is set to a value defined by $L_3 \geqq 2V/T$, toner on the paper sheet is preliminarily heated by the first flash of the flash lamp at the upstream of the aperture of the reflector so as to be easily melted, and then, the toner is fully melted by the second flash at the downstream of the aperture of the reflector and perfectly fixed on the paper sheet.

In this case, it is preferable that the reflector is formed to have a pair of inclined face parts which are disposed on both lateral sides of the flash lamp, inclining like an unfolded fan widened towards the paper sheet and a back face part disposed intermediate the inclined face parts and behind the flash lamp, and that the tilt angle of the inclined face part located at the upstream of the paper conveying direction is gentler than that of the inclined face part at the downstream.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and accompanying drawings which are given by way of illustration only, and thus are not limitative of the present invention, and wherein:

FIG. 1 is a schematic view of an essential part of the structure of an image forming apparatus in which a flash lamp fixing device according to an embodiment of the invention is incorporated;

FIG. 2 is a cross sectional view of a fixing unit according to a first embodiment of the invention;

FIG. 3 is a perspective view, partly broken away, of the reverse side of the flash lamp fixing device according to the first embodiment of the invention;

FIG. 4 is a view illustrating a concrete form of a reflector according to the first embodiment of the invention;

FIG. 5 is a view illustrating the relationship between the half breadth of the reflector and the length of a fixing area, according to the first embodiment of the invention;

FIG. 6 is a chart showing a luminous energy distribution obtained by one flash, according to the first embodiment of the invention;

FIG. 7 is a chart showing a luminous energy distribution obtained by successive flashes according to the first embodiment of the invention in comparison with an example of prior art;

FIG. 8 is a view of a first modification of the first embodiment of the invention;

FIG. 9 is a view of a second modification of the first embodiment of the invention;

FIG. 10 is a view of a third modification of the first embodiment of the invention;

FIG. 11 is a view of a fourth modification of the first embodiment of the invention;

FIG. 12 is a view of a fifth modification of the first embodiment of the invention;

FIG. 13 is a view of a sixth modification of the first embodiment of the invention;

FIG. 14 is a view of a seventh modification of the first embodiment of the invention;

FIG. 15 is a perspective view showing a form of a reflector according to a second embodiment of the invention;

FIG. 16 is a view illustrating irregular light reflection according to the second embodiment of the invention;

FIG. 17 is a chart showing a luminous energy distribution obtained by one flash according to the second embodiment of the invention in comparison with an example of prior art;

FIG. 18 is a chart showing a fixing rate distribution obtained by successive flashes according to the second embodiment of the invention in comparison with an example of prior art;

FIG. 19 is a view of a first modification of the second embodiment of the invention;

FIG. 20 is a view of a second modification of the second embodiment of the invention;

FIG. 21 is a view of a third modification of the second embodiment of the invention;

FIG. 22 is a view of a third embodiment of the invention;

FIG. 23 is a chart of a luminous energy distribution obtained by one flash according to an example of prior art in which a reflector is not employed;

FIG. 24 is a view of a flash lamp fixing device according to an example of prior art in which a reflector is employed; and FIG. 25 is a chart of a luminous energy distribution according to an example of prior art in which a reflector is employed.

BEST MODE FOR CARRYING OUT THE INVENTION

Figure 1:
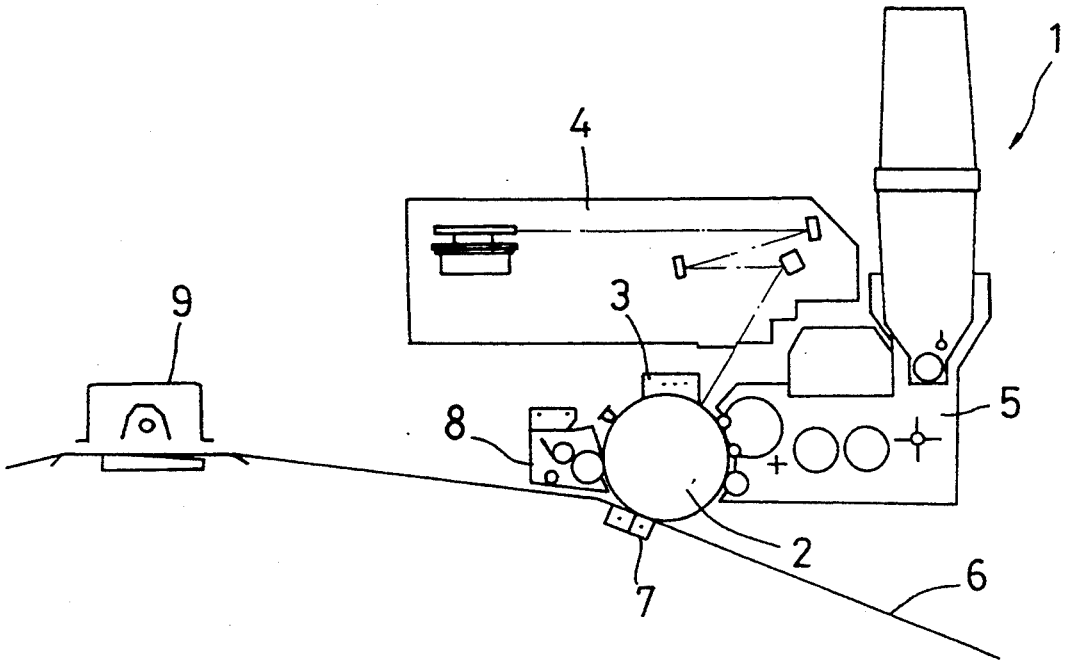
FIGS. 1 to 25 illustrate flash lamp fixing devices according to preferred embodiments of the invention.

Referring now to the drawings, flash lamp fixing devices according to preferred embodiments of the invention will be described hereinbelow.

FIG. 1 schematically shows an essential part of the structure of an image forming apparatus in which a flash lamp fixing device according to a first embodiment of the invention is incorporated.

As shown in FIG. 1, an image forming apparatus 1 in the first embodiment is provided with a photosensitive drum 2 of a cylindrical shape. Disposed above the photosensitive drum 2 is a front charger 3 for uniformly charging the surface of the photosensitive drum 2, and disposed above the front charger 3 is an optical system 4 for forming an electrostatic latent image by directing light to areas other than an image area on the surface of the photosensitive drum 2 charged by the front charger 3. A developing unit 5 is disposed at the side of the photosensitive drum 2, for forming a visible image (toner image) by adhering toner to the electrostatic latent image formed by the optical system 4, the toner being charged to have an opposite polarity to that of the electrostatic latent image. A transferring unit 7 is disposed under the photosensitive drum 2 and adapted to overlay a paper sheet (recording sheet) 6 on the toner image formed by the developing unit 5 and to apply a charge having an opposite polarity to that of the toner to the paper sheet 6 from the reverse side thereof so that the toner image is transferred onto the paper sheet 6 by an electrostatic force. There are provided a cleaning unit 8 located opposite to the developing unit 5 with the photosensitive drum 2 between, for eliminating residual toner on the photosensitive drum 2, and a fixing unit 9 located at the downstream of a paper conveying direction seen from the photosensitive drum 2, for fusing the toner image which has been transferred onto the paper sheet 6 so as to be permanently fixed on the paper sheet 6.

Figure 2:
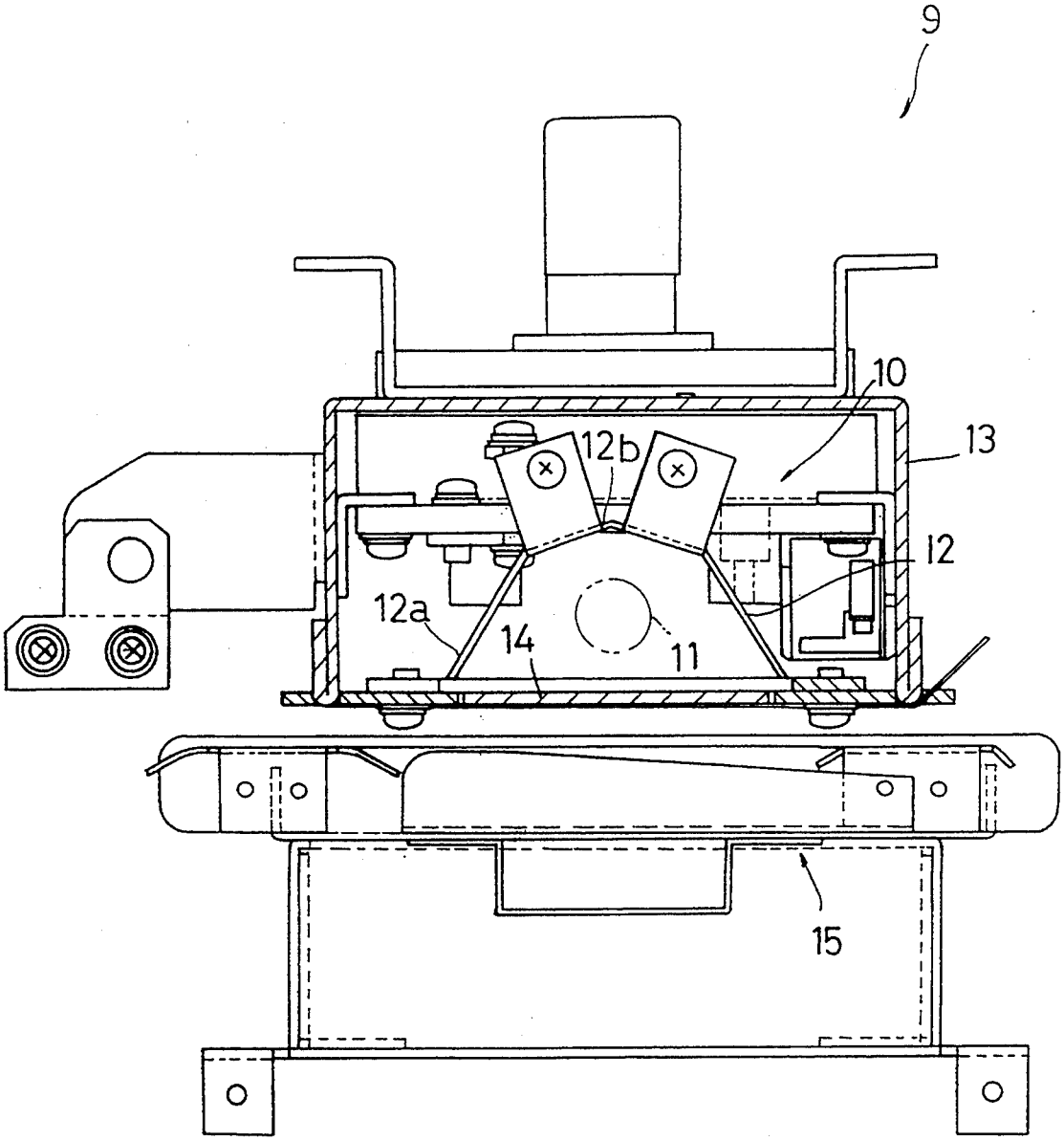
Figure 3:
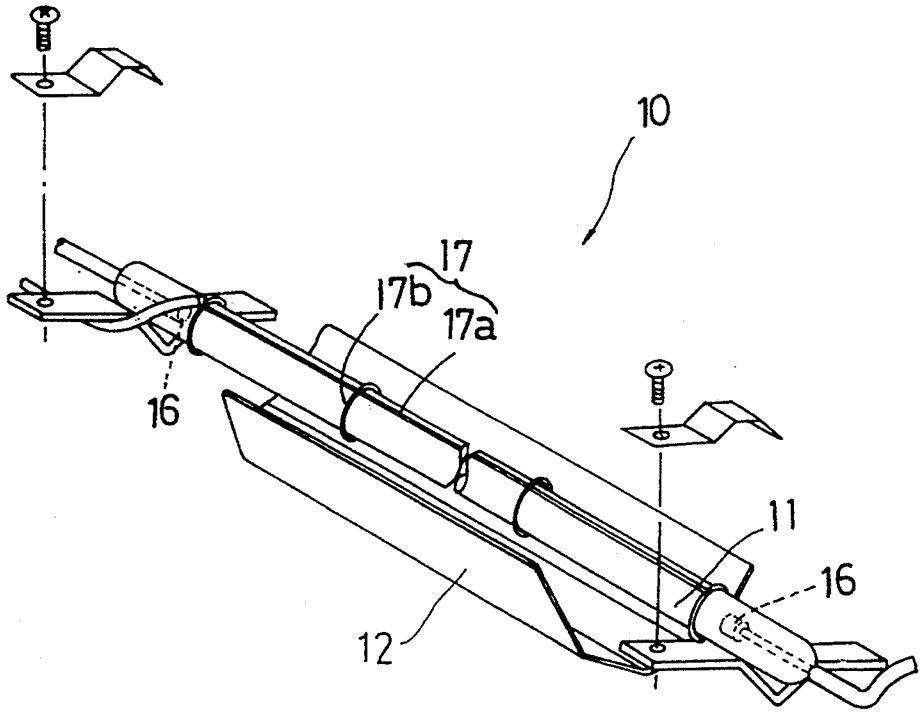

The fixing unit 9 is provided with a flash lamp fixing device 10. As shown in FIGS. 2 and 3, the flash lamp fixing device 10 comprises a flash lamp 11 such as a xenon lamp oriented in a direction perpendicular to the conveying direction of the paper sheet 6 and a reflector 12 fixedly attached to enclose the flash lamp 11 at both lateral sides and the upside thereof. The reflector 12 is housed within a casing 13 and the bottom wall of the casing 13 is provided with a glass plate 14 disposed opposite to the reflector 12. Under the casing 13 is disposed a paper conveying guide 15 for guiding the paper sheet 6 to the fixing unit 9.

In the image forming apparatus 1 having the above arrangement, the paper sheet 6, which is conveyed to the fixing unit 9 after the toner image has been transferred thereto by the transferring unit 7, passes under the flash lamp fixing device 10, being guided by the paper conveying guide 15. At that time, toner on the paper sheet 6 is fixed by means of light emitted from the flash lamp fixing device 10.

The flash lamp 11 comprises main electrodes 16 disposed at both ends thereof and an auxiliary electrode 17 which is comprised of a trigger wire 17*a* extending in the lengthwise direction of the flash lamp 11 along its peripheral face and a plurality of trigger rings 17*b* connected to the trigger wire 17*a*.

The reflector 12 is made up of a pair of inclined face parts 12*a* located on both lateral sides of the flash lamp 11, inclining like an unfolded fan widened towards the paper sheet 6 and a back face part 12*b* which is located between these inclined face parts 12a and behind the flash lamp 11. The back face part 12*b* is angled, with the centre projecting outwardly.

In the first embodiment, the distance between aperture edges a (see FIG. 4) of the reflector 12 is so determined that during the passage of the paper sheet 6 under the reflector 12, the flash lamp 11 performs flash fixing once or twice on the paper sheet 6. More specifically, the flash lamp fixing device 10 is so designed that the following equation holds:

$$V/T > L_1 > V/T - L_2/2 \quad (1)$$

where V is the conveying speed of the paper sheet 6; T is the flash cycle of the flash lamp 11; $L_1$ is the half breadth of the aperture of the reflector 12; $L_2$ is the length of an area in which fixing can be done by one flash of the flash lamp 11 (it is assumed that the area in which fixing is done by one flash is only the area just under the flash lamp 11).

Figure 5A:
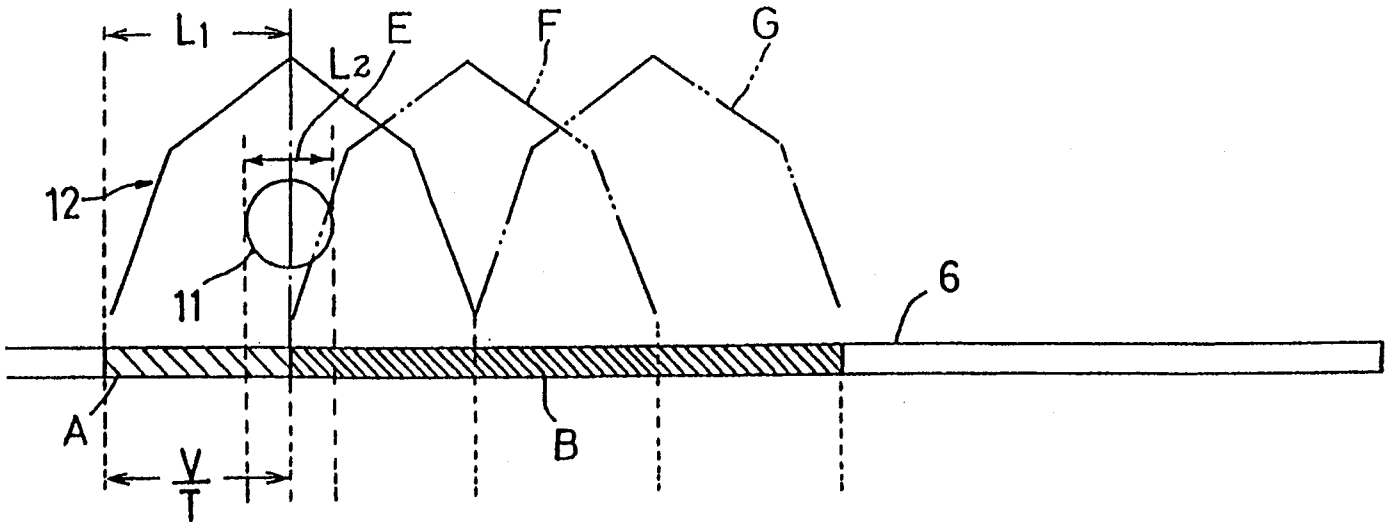
Figure 5B:
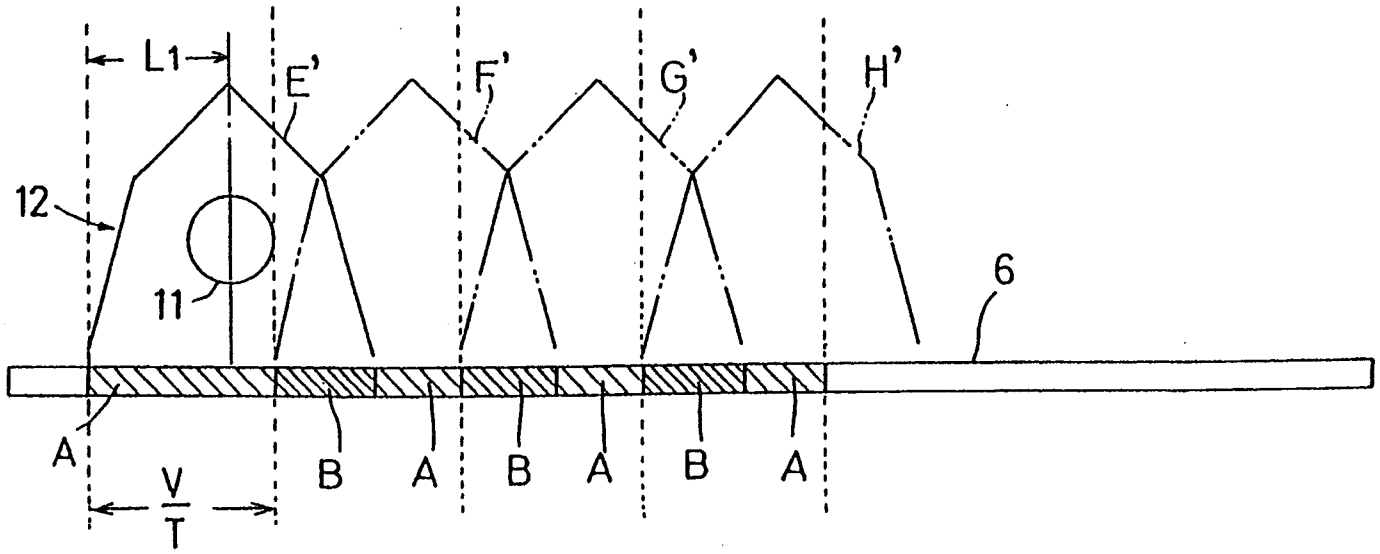

FIG. 5 shows the relationship between the half breadth $L_1$ of the aperture of the reflector 12 and the length of the area where fixing is done by the flash lamp 11. FIG. 5(*a*) shows the fixing condition when the half breadth $L_1$ has a maximum value ($L_1=V/T$) within the range defined by the equation (1), whilst FIG. 5(*b*) shows the fixing condition when the half breadth $L_1$ has a minimum value ($L_1=V/T-L_2/2$) within the range defined by the equation (1). The hatching A represents an area on the paper sheet 6 where flash is performed one time and the hatching B represents area on the paper sheet 6 where flash is performed two times. Note that FIG. 5 is depicted provided that the paper sheet 6 is stationary and the flash lamp 11 and the reflector 12 are moved in relation to the paper sheet 6. Note that the conveying speed V of the paper sheet 6 and the flash cycle of the flash lamp 11 are not varied between FIGS. 5(*a*) and 5(*b*).

As shown in FIG. 5(*a*), where $L_1=V/T$, the flash lamp 11 performs the first flash fixing when the reflector 12 is at the position indicated by the solid line E, and then performs the second flash fixing when the reflector 12 has come to the position indicated by the two-dot chain line F. Thereafter, it performs the third flash fixing when the reflector 12 has come to the position indicated by the two-dot chain line G. Accordingly, flash fixing is performed two times in the hatched area B of the paper sheet 6. More specifically, the first flash fixing and second flash fixing, or the second flash fixing and third flash fixing are performed in an overlapping manner in the hatched area B. In other words, when $L_1=V/T$, during the passage of the paper sheet 6 under the reflector 12 of the flash lamp fixing device 10, flash fixing is performed two times without intermission on the surface of the paper sheet 6 except for the hatched area A in FIG. 5(*a*) which has a length of V/T and passes under the reflector 12 at the start of fixing.

As shown in FIG. 5(*b*), when $L_1=V/T-L_2/2$, the flash lamp 11 performs the first flash fixing when the reflector 12 is at the position indicated by the solid line E', the second flash fixing when the reflector 12 has come to the position indicated by the two-dot chain line F', the third flash fixing when the reflector 12 has come to the position indicated by the two-dot chain line G' and the fourth flash fixing when the reflector 12 has come to the position indicated by the two-dot chain line H'. Like the case of FIG. 5(*a*), flash fixing is accordingly done twice in the hatched areas B. Specifically, when $L_1=V/T-L_2/2$, flash fixing is performed one time in the first hatched area A in FIG. 5(*b*) which has a length of V/T and passes under the reflector 12 at the start of fixing as well as areas which come to a position just under the flash lamp 11 (these areas are also represented by the hatched areas A in FIG. 5(*b*)), whereas flash fixing is performed two times in other areas (=the hatched areas B) than the above-mentioned areas. It is understood that, apart from the area which passes under the reflector 12 at the start of fixing, only one flash fixing is performed in the areas which come to a position just under the flash lamp 11. This is because satisfactory fixing effects can be obtained from one flash fixing in the areas which come to a position just under the flash lamp 11. Therefore, by setting the half breadth $L_1$ of the aperture of the reflector 12 to satisfy the equation (1), the flash lamp 11 can perform flash fixing on the paper sheet 6 once or twice during the time the paper sheet 6 passes under the reflector 12, so that the distribution of luminous energy which reaches the paper sheet 6 by flashing of the flash lamp 11 can be averaged.

Figure 4:
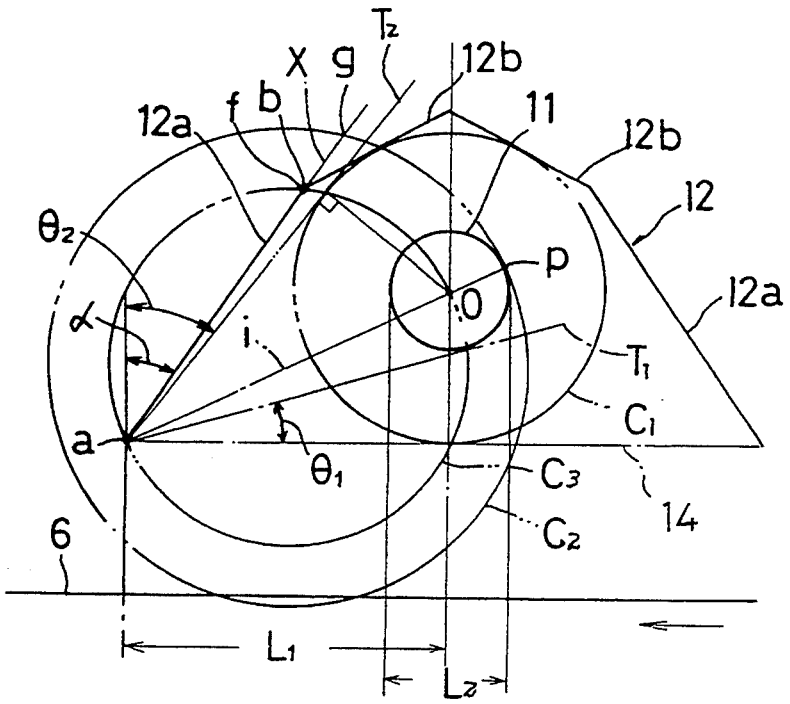

With reference to FIG. 4, a concrete form of the reflector 12 will be explained.

As shown in FIG. 4, in the reflector 12 of the first embodiment, the distance between the aperture plane where the glass plate 14 is disposed and the center of the flash lamp 11 is equal to the radius of a safety distance critical circle $C_1$ in which the leakage of electric charge occurs. Where $\theta_1$ represents the included angle between a tangent $T_1$ which passes through one of aperture edges a of the reflector 12, being tangent to the flash lamp 11 on the side of the aperture and the plane of the aperture; and $\theta_2$ represents the included angle between a tangent $T_2$ which passes through the aperture edge a, being tangent to the safety distance critical circle $C_1$ centered on the centre of the flash lamp 11 and a plane normal to the aperture plane, the tilt angle $\alpha$ of each of the inclined face parts 12*a* in relation to the plane normal to the aperture plane is set to be not less than $\theta_1$ and not more than $\theta_2$.

If the tilt angle $\alpha$ of each of the inclined face parts 12*a* is set to $\theta_1$, light emitted from the flash lamp 11 to the aperture edge a of the inclined face part 12*a* will be reflected in a direction at right angles to the aperture plane so that the light can enter the paper sheet 6 from the aperture plane, at right angles to the paper sheet 6.

On the other hand, if the tilt angle $\alpha$ of each of the inclined face parts 12*a* is set less than $\theta_1$, light reflected off the respective inclined face parts 12*a* deviates to the center of the reflector 12, and light reflected off a posterior end b of one of the inclined face parts 12*a* is directed to the other inclined face part 12*a* and vice versa, resulting in secondary reflection. This undesirably leads to such a situation that the optical path is prolonged and therefore luminous energy reaching the paper sheet 6 is damped.

Although it is preferable to set the tilt angle $\alpha$ of each of the inclined face parts 12*a* to a value which is not less than $\theta_1$ and as large as possible, if the tilt angle a exceed $\theta_2$, it results in such an undesirable situation that the inclined face parts 12*a* intersect the safety distance critical circle $C_1$ and the leakage of electric charge from the flash lamp 11 to the inclined face parts 12*a* is likely to occur. If the tilt angle $\alpha$ is set to $\theta_2$, the distance between the flash lamp 11 and the respective inclined face parts 12*a* can be minimized within the range that the leakage of electric charge does not occur, and the damping amount of luminous energy of light reflected at the inclined face parts 12*a* can be restrained.

in such a case, by setting the posterior end b of each of the inclined face parts 12*a* closer to the aperture edge a than an intersection g of an oblique line X of the inclined face part 12*a* and a circle $C_2$ which encloses the flash lamp 11 being tangent thereto and is centered on a middle point i between the center o of the flash lamp 11 and the aperture edge a, an angle agp between the oblique line X and a straight line connecting the intersection g to a point of contact p of the circle $C_2$ tangent to the flash lamp 11 can be made to be a right angle or obtuse angle, so that light from the flash lamp 11 enters each of the inclined face parts 12*a*, inclining towards the aperture edge a, rather than making a right angle with the posterior end b of the inclined face part 12*a* and the light is then reflected towards the aperture plane. As a result, the second reflection in which light from the posterior end b of either of the inclined face parts 12*a* is directed to and reflected at the other inclined face part 12*a* is prevented, thereby reducing the damping of luminous energy caused by the prolongation of the optical path.

On the other hand, if the posterior end b of the inclined face part 12*a* is set father from the aperture edge a than the intersection g, light directed more closely to the posterior end b of the inclined face part 12*a* than the intersection g will be reflected towards the other inclined face part 12*a* and the back face part 12*b*. Therefore, the light enters the paper sheet 6 after being secondly reflected at the other inclined face part 12*a* and the back face part 12*b*, with the result that the optical path is undesirably prolonged and thus the damping of luminous energy is increased.

Figure 6:
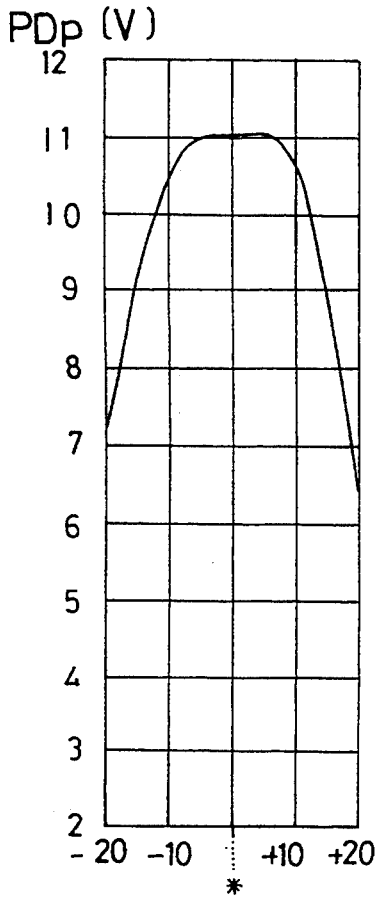
Figure 7:
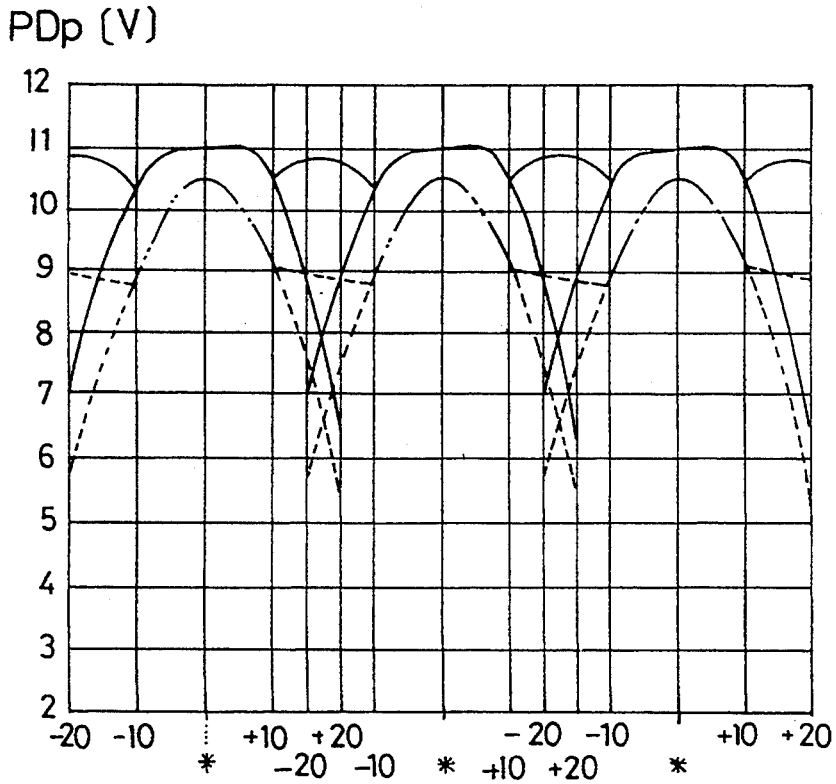
Figure 25:
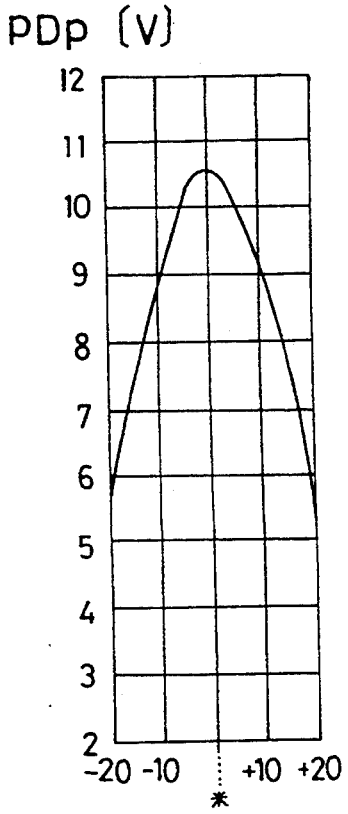

FIG. 6 shows the distribution of luminous energy generated by one flash of the flash lamp fixing device 10 according to time first embodiment whilst FIG. 7 shows the distribution of luminous energy generated by successive flashes of the flash lamp fixing device 10 in comparison with an example of prior art (indicated by a broken line). It is clearly understood from FIGS. 6, 7 and 25 that the flash lamp fixing device 10 of the first embodiment is improved over the prior art in that it achieves more averaged and higher-level luminous energy distributions.

Although the first embodiment has been described with the posterior end b of the inclined face part 12*a*, which is set closer to the aperture edge a than an intersection g of the oblique line X of the inclined face part 12*a* and the circle $C_2$ which encloses the flash lamp 11 being tangent thereto and is centered on the middle point i between the centre o of the flash lamp 11 and the aperture edge a, it is more preferable that the posterior end b is set at an intersection f of the oblique line X and a circle $C_3$ the diameter of which is a line segment connecting the centre o of the flash lamp 11 and the aperture edge a, or alternatively the posterior end b is set closer to the aperture edge a than the intersection f.

Although the first embodiment has been described with the reflector 12 which is so designed to have an angled back face part projecting outwardly, various configurations such as described below are possible for the reflector 12.

Figure 8:
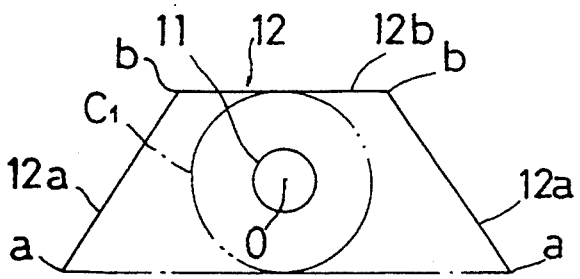

1. In the example shown in FIG. 8, the back face part 12*b* of the reflector 12 takes the form of a flat face which is parallel with the aperture plane, being tangent to the safety distance critical circle $C_1$ or passing outside the safety distance critical circle $C_1$.

Figure 9:
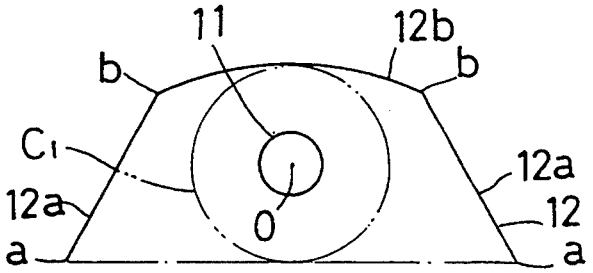

2. In the example shown FIG. 9, the back face part 12*b* of the reflector 12 takes the form of a curved face which is tangent to the safety distance critical circle $C_1$ or which passes outside the safety distance critical circle $C_1$.

Figure 10:
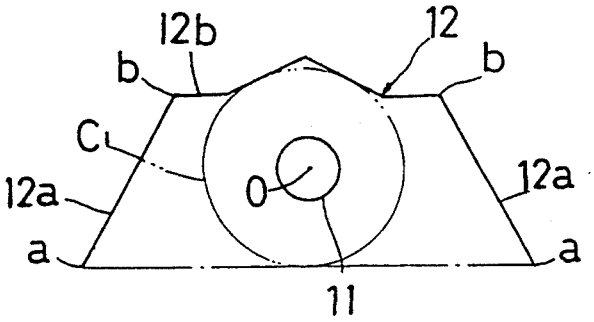

3. In the example shown in FIG. 10, the back face part 12*b* of the reflector 12 is a bent face, like the case of FIG. 4, which is tangent to the safety distance critical circle $C_1$ or passes outside the safety distance critical circle $C_1$. The back face part 12*b* differs from that of FIG. 4 in that it comprises of an angled face projecting in a direction opposite to the aperture plane and flat faces which continue from both sides of the angled face being parallel with the aperture plane.

Figure 11:
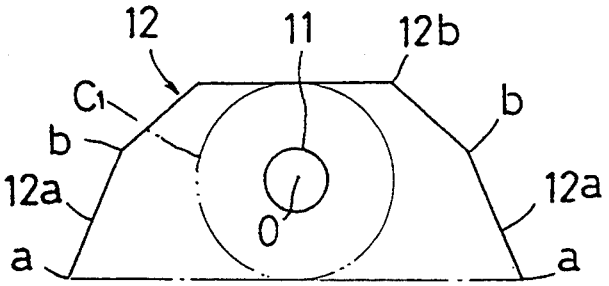

4. In the example shown in FIG. 11, the back face part 12*b* of the reflector 12 is a bent face comprising a flat face and slant faces. The flat face extends in parallel with the aperture plane, being tangent to the safety distance critical circle $C_1$ or passing outside the safety distance critical circle $C_1$, whilst the slant faces continue from both sides of the flat face.

Figure 12:
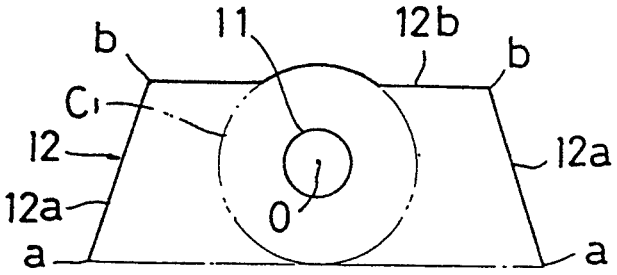

5. In the example shown in FIG. 12, the back face part 12*b* comprises a curved face along (coincident with) an arc of the safety distance critical circle $C_1$ and flat faces which respectively extend in parallel with the aperture plane, continuing from both sides of the curved face.

Figure 13:
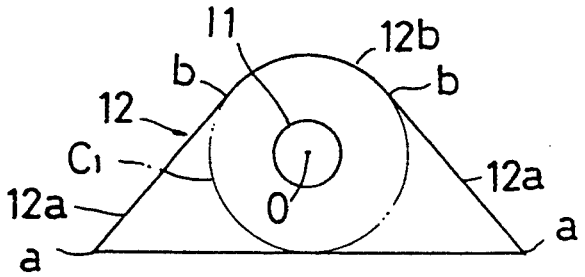

6. In the example shown in FIG. 13, the tilt angle $\alpha$ of the inclined face part 12*a* is equal to $\theta_2$, and the posterior end b of the inclined face part 12*a* is set at the point of contact of the tangent $T_2$ to the safety distance critical circle $C_1$. The back face part 12*b* is a curved face along (coincident with) an arc of the safety distance critical circle $C_1$.

It should be understood that when the configuration of the reflector 12 is modified as described in the columns (1) to (6) (FIGS. 8 to 13), the same effects as described in the first embodiment can be achieved.

Figure 14:
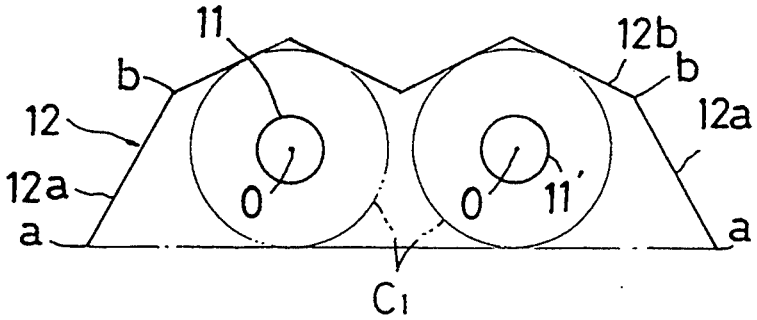

FIG. 14 shows the structure of a reflector according to another modification of the first embodiment, in which a plurality of flash lamps are provided. In this modification, there are provided a plurality of flash lamps 11, 11' (two flash lamps are employed in the example shown in FIG. 14) which are parallel with each other and spaced a predetermined distance apart from the aperture plane. Disposed outside the flash lamps 11, 11' are the inclined face parts 12*a* and the back face part 12*b* comprising continued, angled faces. In this case, the half breadth of the aperture is set to a value obtained by adding one-half the distance between the flash lamps 11 and 11' to the half breadth $L_1$ defined by the equation (1).

In the flash lamp fixing device according to the first embodiment and its modifications, the half breadth $L_1$ of the aperture of the reflector 12 is defined by the equation (1) so that during the passage of the paper sheet 6 through the flash lamp fixing device, the paper sheet 6 receives one or two flashes and accordingly the distribution of luminous energy on the paper sheet 6 can be averaged.

The tilt angle $\alpha$ of each of the inclined face parts 12*a* is set within the range of $\theta_1 \geqq \alpha \geqq \theta_2$, which positively prevents the occurrence of the leakage of electric charge to the inclined face parts 12*a*. Furthermore, by setting the tilt angle $\alpha$ of the inclined face part 12*a* to $\theta_2$, the distance between the respective inclined face parts 12*a* and the flash lamp 11 can be minimized within the range that the leakage of electric charge does not occur, thereby restraining the damping amount of luminous energy of light reflected at the inclined face parts 12*a*.

The above-described effects synergistically enhances one another so that averaged and high-level luminous energy can reach over a large area of the paper sheet 6.

According to a second embodiment, the structure of a reflector for averaging the distribution of luminous energy reaching on the paper sheet 6 will be explained below.

Figure 15:
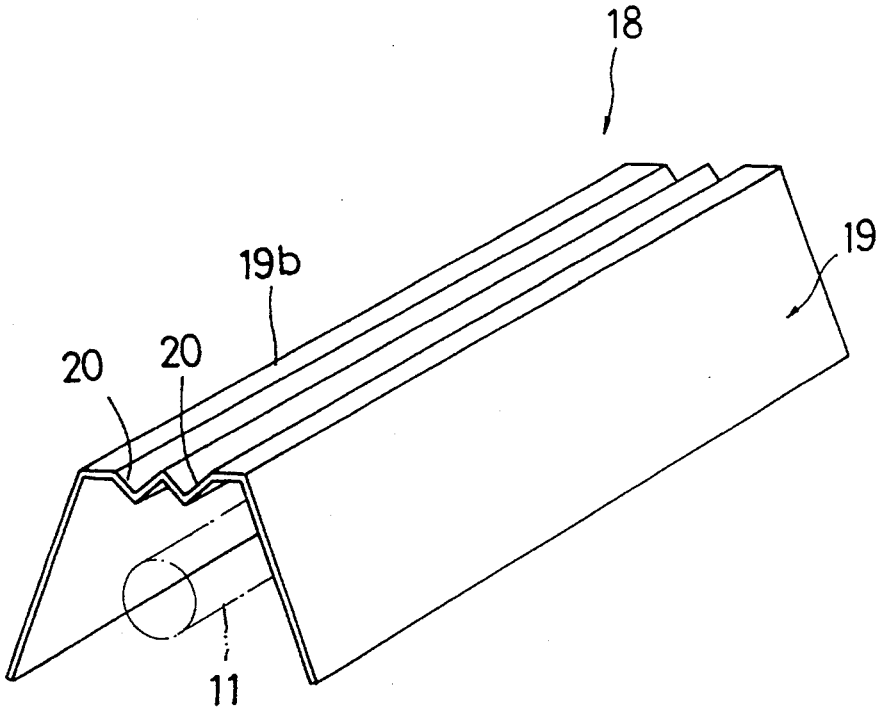
Figure 16:
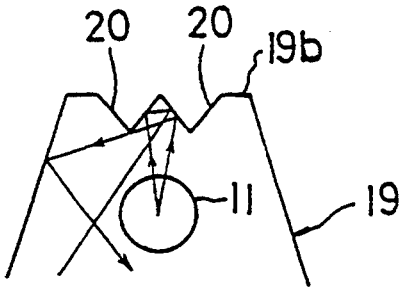

FIG. 15 shows a flash lamp fixing device 18 of the second embodiment, in which a reflector 19 is so formed to have a back face part 19*b* comprising two angled faces 20 which are symmetrically placed and caved in a direction toward the aperture. With such an arrangement of the reflector 19, light emitted from the flash lamp 11 is irregularly reflected at the angled faces 20 of the back face part 19*b* so as to be dispersed to the right and left as shown in FIG. 16 so that the distribution of luminous energy on the paper sheet can be averaged, thereby improving the fixing rate.

Figure 17A:
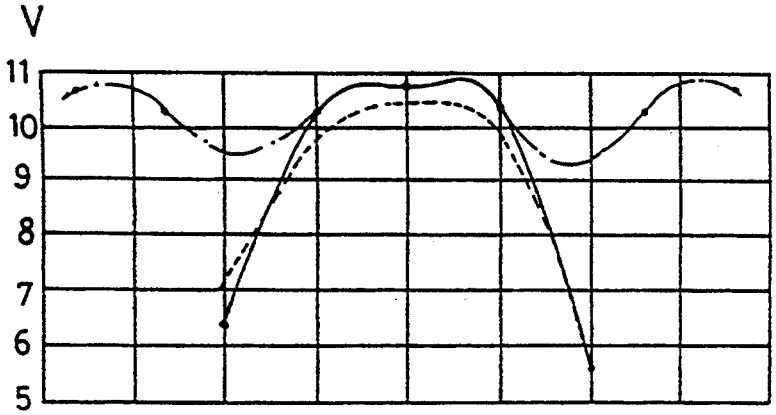
Figure 17B:
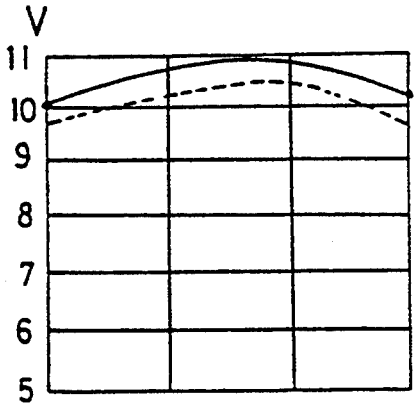

FIG. 17 shows the comparison between the luminous energy distributions obtained by one flash of the flash lamp fixing device 18 of the second embodiment and those obtained in an example of prior art (in which a flat back face part is employed). The chart (a) is concerned with the distribution in the paper conveying direction, whilst the chart (b) is concerned with the distribution in the lengthwise direction of a flash lamp. In both charts, the solid line represents the second embodiment and the broken line represents the example of prior art. The one-dot chain line of the chart (a) represents the distribution of luminous energy generated by successive flashes of the flash lamp of the second embodiment.

Figure 18A:
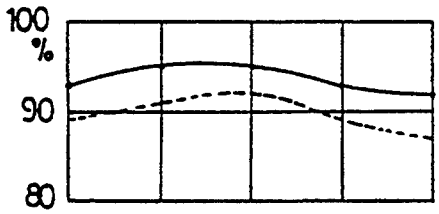
Figure 18B:
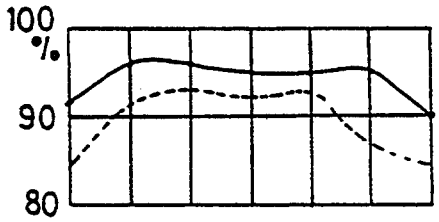

FIG. 18 shows the comparison between the fixing rate distributions obtained by successive flashes of the flash lamp fixing device 18 of the second embodiment and those obtained in an example of prior art. The chart (a) is concerned with the distribution in the paper conveying direction, whilst the chart (b) is concerned with the distribution in the lengthwise direction of a flash lamp. In both charts, the solid line represents the second embodiment and the broken line represents the example of prior art.

It is obvious from these distribution charts that luminous energy in the neighbourhood of the area just under the flash lamp of the flash lamp fixing device 18 of the second embodiment is more evenly distributed, compared with that of the example of prior art. By virtue of the areas on which flash fixing is performed in an overlapping manner, the fixing rate of the successive flashing in the second embodiment is improved over that of the prior art by approximately 5%.

Figure 19:
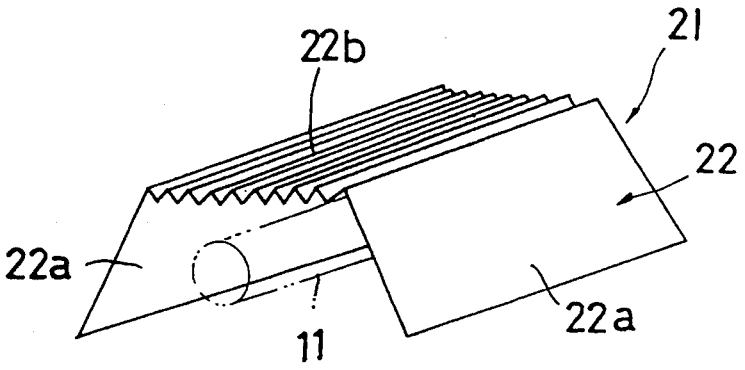

FIG. 19 shows a flash lamp fixing device 21 according to a first modification of the second embodiment. In this flash lamp fixing device 21, a reflector 22 has a back face part 22*b* which takes the form of a bellows in which a number of angled faces which project in a direction opposite to the aperture plane or caves in a direction towards the aperture plane are successively aligned. In such a reflector 22, light emitted from the flash lamp 11 can be irregularly reflected at the back face part 22*b* so as to be dispersed to the right and the left, similarly to the second embodiment shown in FIG. 15, so that the distribution of luminous energy on the paper sheet can be averaged.

Although only the back face part 22b of the reflector 22 is made into a bellows-like shape in the above modification, not only the back face part 22b but also inclined face parts 22a disposed at both lateral sides of the flash lamp 11 may be made into a bellow-like shape.

Figure 20:
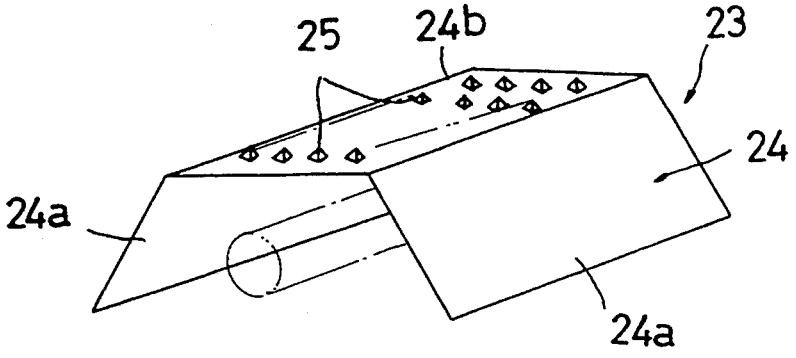

FIG. 20 shows a second modification of the second embodiment. A flash lamp fixing device 23 according to the second modification is designed such that a reflector 24 includes a back face part 24b provided with a number of projections 25 regularly disposed. Each projection 25 is made in the form of a square pyramid and projects in a direction opposite to the aperture plane (i.e., outwardly). With this arrangement, the same effects as described above can be achieved. It is to be noted that the configuration of the projections 25 is not limited to a square pyramid but may be a hexagonal pyramid or any other polygonal pyramids. The projections 25 may be also provided at the inclined face parts 24a as above mentioned. Instead of the projections 25, there may be provided concaves each of which caves towards the aperture plane (inwardly) and takes the form of a polygonal pyramid.

Figure 21:
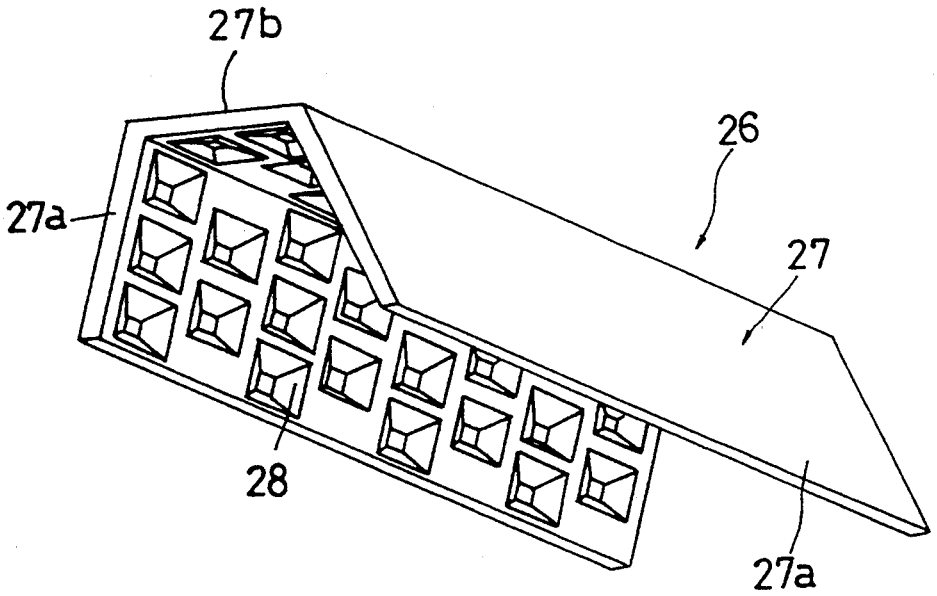

FIG. 21 shows a third modification of the second embodiment, according to which a flash lamp fixing device 26 has a reflector 27 including a number of concaves 28 in the form of a truncated square pyramid. These concaves 28 are regularly disposed at the inner sides of inclined face parts 27a and back face part 27b. The configuration of the concaves 28 is not necessarily limited to a truncated square pyramid but may be a truncated triangular pyramid or any other truncated polygonal pyramids. Instead of the concaves 28, there may be provided projections in the form of a truncated polygonal pyramid which project towards the aperture plane. In addition, the alignment pattern of these concaves or projections is not limited to the patterns shown in the drawings and various patterns can be employed. Obviously, these concaves or projections of the third modification may be provided at only the back face part 27b like the second modification.

Figure 22:
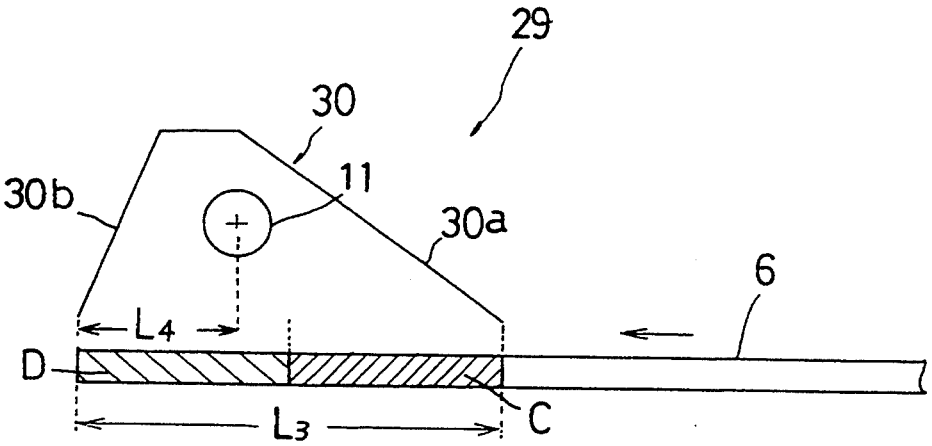
Figure 23:
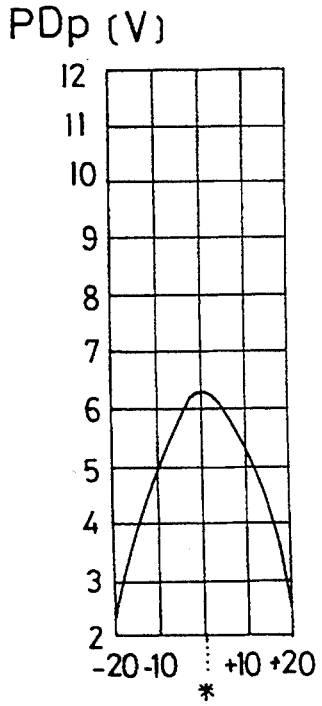
Figure 24:
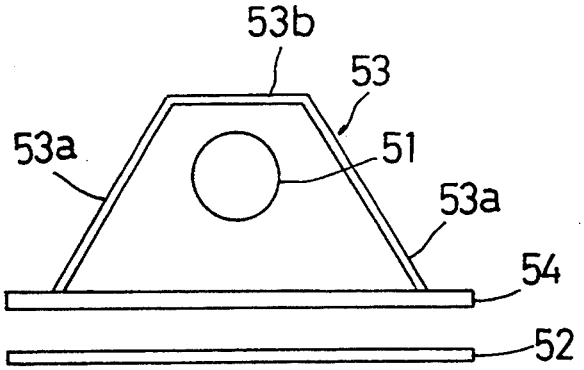

Reference is made to FIG. 22 for explaining the structure of a fixing device for stabilizing the fixing of toner according to a third embodiment.

In a flash lamp fixing device 29 according to the third embodiment, a reflector 30 is asymmetrically formed such that the tilt angle of an inclined face part 30a located at the upstream of the paper conveying direction is gentler than that of an inclined face part 30b located at the downstream of the paper conveying direction. The flash lamp 11 is disposed at a position which deviates from the center of the aperture width of the reflector 30 towards the downstream of the paper conveying direction, more specifically, a position which satisfies $L_4 \geqq L_3/2$. In order to perform at least two flashes on the paper sheet 6, the aperture width $L_3$ is set so as to satisfy the following equation:

$$L_3 \geqq 2V/T \quad (2)$$

where V is the conveying speed of the paper sheet 6; T is the flash cycle of the flash lamp 11; and $L_3$ is the aperture width of the reflector 30.

With the above arrangement, toner on the paper sheet 6 which is passing under the reflector 30 is so preheated at the upstream (indicated by the hatched area C) as to be in a nearly melted condition by comparatively weak luminous energy generated by the first flash, and then completely melted at the downstream (indicated by the hatched area D), receiving stronger luminous energy generated by the second flash and fixed on the paper sheet 6. Such a two-stage fixing composed of the preheating stage and the fixing stage eliminates the degradation of fixing caused by fixing blurs, the occurrence of toner void (rupture) phenomenon and the like, whereby stable fixing can be accomplished.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A flash lamp fixing device comprising a flash lamp and a reflector which is so formed as to enclose the flash lamp except for an aperture formed at a side of the flash lamp, for reflecting part of light emitted from the flash lamp towards the aperture, wherein the equation $$V/T \geqq L_1 \geqq V/T - L_2/2$$

holds, where V is the conveying speed of a paper sheet; T is the flash cycle of the flash lamp; $L_1$ is the half breadth of the aperture of the reflector; and $L_2$ is the length of an area in which fixing can be done by one flash of the flash lamp.

2. A flash lamp fixing device comprising a flash lamp and a reflector which is so formed as to enclose the flash lamp except for an aperture formed at a side of the flash lamp, for reflecting part of light emitted from the flash lamp towards the aperture, wherein the reflector is formed with a pair of inclined face parts which are disposed on both lateral sides of the flash lamp, inclining like an unfolded fan widened towards a paper sheet and a back face part disposed intermediate the inclined face parts and behind the flash lamp, and wherein where $\theta_1$ represents the included angle between a tangent which passes through one of aperture edges of the reflector, being tangent to the flash lamp on the side of the aperture and the plane of the aperture; and $\theta_2$ represents the included angle between a tangent which passes through the aperture edge, being tangent to a safety distance critical circle and a plane normal to the aperture plane, the safety distance critical circle with centre at the centre of the flash lamp being an area where the leakage of electric charge does occur, the tilt angles of the respective inclined face parts in relation to the plane normal to the aperture plane are set to be not less than $\theta_1$ and not more than $\theta_2$.

3. The flash lamp fixing device as claimed in claim 2, wherein each of the inclined face parts has a posterior end which is located closer to one of the aperture edges than the intersection of the oblique line of the inclined face part and a circle which encloses the flash lamp being tangent thereto and is centered on a middle point between the centre of the flash lamp and the aperture edge.

4. The flash lamp fixing device as claimed in claim 3, wherein the back face part is configured to be a flat face which is parallel with the aperture plane, being tangent to the safety distance critical circle or passing outside the safety distance critical circle.

5. The flash lamp fixing device as claimed in claim 3, wherein the back face part is configured to be a curved passes outside the safety distance critical circle.

6. The flash lamp fixing device as claimed in claim 3, wherein the back face part is configured to be a bent face which is tangent to the safety distance critical circle or passes outside the safety distance critical circle.

7. The flash lamp fixing device as claimed in claim 2, wherein the back face part is configured to be a flat face which is parallel with the aperture plane, being tangent to the safety distance critical circle or passing outside the safety distance critical circle.

8. The flash lamp fixing device as claimed in claim 2, wherein the back face part is configured to be a curved face which is tangent to the safety distance critical circle or passes outside the safety distance critical circle.

9. The flash lamp fixing device as claimed in claim 2, wherein the back face part is configured to be a bent face which is tangent to the safety distance critical circle or passes outside the safety distance critical circle.

10. The flash lamp fixing device as claimed in claim 9, wherein the bent face comprises an angled face projecting in a direction opposite to the aperture plane.

11. The flash lamp fixing device as claimed in claim 9, wherein the bent face comprises an angled face projecting in a direction opposite to the aperture plane and flat faces which continue from both sides of the angled face, being parallel with the aperture plane.

12. The flash lamp fixing device as claimed in claim 9, wherein the bent face comprises a flat face parallel with the aperture plane and slant faces which continue from both sides of the flat face.

13. The flash lamp fixing device as claimed in claim 9, wherein the bent face comprises a curved face along an are of the safety distance critical circle and flat faces which continue from both sides of the curved face, being parallel with the aperture plane.

14. The flash lamp fixing device as claimed in claim 2, wherein the tilt angles of the inclined face parts are set to $\theta_2$, each of the inclined face parts has a posterior end which is set at the point of contact of a tangent to the safety distance critical circle, and the back face part is a curved face along an arc of the safety distance critical circle.

15. The flash lamp fixing device as claimed in any one of claims 2, 3 or 7–14, wherein a plurality of flash lamps are disposed in parallel with each other, being a specified distance separated from the aperture plane and the inclined face parts are disposed outside the outermost flash lamps.

16. A flash lamp fixing device comprising a flash lamp and a reflector which is so formed as to enclose the flash lamp except for an aperture formed at a side of the flash lamp, for reflecting part of light emitted from the flash lamp towards the aperture, wherein the reflector is formed with a pair of inclined face parts which are disposed on both lateral sides of the flash lamp, inclining like an unfolded fan widened towards a paper sheet and a back face part disposed intermediate the inclined face parts and behind the flash lamp, and wherein the back face part is composed of two angled faces which are symmetrically placed and caved in a direction toward the aperture plane.

17. A flash lamp fixing device comprising a flash lamp and a reflector which is so formed as to enclose the flash lamp except for an aperture formed at a side of the flash lamp, for reflecting part of light emitted from the flash lamp towards the aperture, wherein the reflector is formed with a pair of inclined face parts which are disposed on both lateral sides of the flash lamp, inclining like an unfolded fan widened towards a paper sheet and a back face part disposed intermediate the inclined face parts and behind the flash lamp, and wherein at least the back face part of the reflector is formed in a bellows-like shape in which angled faces projecting in a direction opposite to the aperture plane and caving in a direction towards the aperture plane are successively aligned.

18. A flash lamp fixing device comprising a flash lamp and a reflector which is so formed as to enclose the flash lamp except for an aperture formed at a side of the flash lamp, for reflecting part of light emitted from the flash lamp towards the aperture, wherein the reflector is formed with a pair of inclined face parts which are disposed on both lateral sides of the flash lamp, inclining like an unfolded fan widened towards a paper sheet and a back face part disposed intermediate the inclined face parts and behind the flash lamp, and wherein at least the back face part of the reflector is formed to include a plurality of projections or concaves disposed regularly, each of which assumes the form of a polygonal pyramid.

19. A flash lamp fixing device comprising a flash lamp and a reflector which is so formed as to enclose the flash lamp except for an aperture formed at a side of the flash lamp, for reflecting part of light emitted from the flash lamp towards the aperture, wherein the flash lamp is disposed in a position deviated from the centre of the width of the aperture of the reflector towards the downstream of a paper conveying direction, and wherein where the conveying speed of a paper sheet is represented by V; the flash cycle of the flash lamp is represented by T; and the width of the aperture of the reflector is represented by $L_3$, the equation $$L_3 \geqq 2V/T$$

holds.

20. The flash lamp fixing device as claimed in claim 19, wherein the reflector is formed with a pair of inclined face parts which are disposed on both lateral sides of the flash lamp, inclining like an unfolded fan widened towards a paper sheet and a back face part disposed intermediate the inclined face parts and behind the flash lamp, and wherein the tilt angle of the inclined face part at the upstream of the paper conveying direction is gentler than that of the inclined face part at the downstream of the paper conveying direction.

* * * * *